United States Patent [19]

Niederer

[11] 4,295,569

[45] Oct. 20, 1981

[54] APPARATUS FOR SORTING TEXTILE BOBBINS

[75] Inventor: Kurt W. Niederer, Charlotte, N.C.

[73] Assignee: The Terrell Machine Company, Charlotte, N.C.

[21] Appl. No.: 78,700

[22] Filed: Sep. 25, 1979

[51] Int. Cl.[3] ..... B07C 5/04

[52] U.S. Cl. ..... 209/634; 209/635; 209/693; 209/700; 209/927

[58] Field of Search ..... 209/693, 700, 927, 691, 209/692, 694, 680, 634, 635

[56] References Cited

U.S. PATENT DOCUMENTS 1,227,118 5/1917 Colman ..... 209/927

4,078,663 3/1978 Barker ..... 209/693

FOREIGN PATENT DOCUMENTS 1157893 11/1963 Fed. Rep. of Germany ..... 209/693

*Primary Examiner*—Allen N. Knowles

*Attorney, Agent, or Firm*—Richards, Shefte & Pinckney

[57] ABSTRACT

An apparatus for sorting textile bobbins into groups of empty bobbins and bobbins with residual yarn thereon, utilizing an inclined upwardly moving conveyor belt covered with card clothing for conveying upwardly and discharging therefrom bobbins having residual yarn thereon by engagement of the yarn by the card clothing and for downward sliding discharge therefrom of empty bobbins, and utilizing another inclined conveyor belt to transport and feed bobbins onto the card conveyor. By utilizing a wall extending between the two conveyor belts and providing an opening therein of a predetermined size and shape at the location at which bobbins are fed onto the card belt such that only empty bobbins or bobbins having less than a predetermined amount of yarn thereon can pass therethrough onto the card belt, bobbins can be additionally sorted according to the amount of yarn thereon.

32 Claims, 14 Drawing Figures

APPARATUS FOR SORTING TEXTILE BOBBINS

BACKGROUND OF THE INVENTION

The present invention relates to apparatus for sorting textile bobbins, specifically relating to the sorting of textile bobbins according to the presence or absence of residual yarn wrappings thereon and according to the amount of residual yarn wrapped thereabout.

As is well known in the yarn handling field of the textile industry, numerous textile operations involve the use of yarn or other filamentary material taken from textile yarn packages in which yarn is wrapped about bobbins, tubes, or the like. For the purposes of describing the present invention and to facilitate the understanding of the present invention, such bobbins, tubes, or the like are referred to herein generically as "bobbins" and such term should be understood to include all such yarn carrying devices. In the continuation of such textile operations, such bobbins are generally replaced before being fully spent. Therefore, before such replaced bobbins can be reused, the residual yarn wrapped thereabout must be removed.

Basically, such spent bobbins comprise bobbins of three general types: empty bobbins having no residual yarn remaining thereon, bobbins having a relatively small amount of yarn remaining thereon which yarn, due to the small amount thereof, is not generally usable, and bobbins having a sufficiently large amount of residual yarn wrapped thereabout to warrant the reclamation of the yarn for use. Certain textile yarn handling operations, e.g. winding operations, will generate spent bobbins falling within all three of the above categories, while other such operations will normally generate bobbins within only the first two categories, e.g. a textile machine for stripping residual yarn from bobbins, which will fail to strip an average of one to four bobbins in fifty. Of these three types of spent bobbins, the empty bobbins are, of course, immediately reusable. However, stripping of the residual yarn from the bobbins having a small amount of residual yarn thereon is necessary before such bobbins may be reused, and unwinding of the yarn from the bobbins having a larger amount of yarn thereon is generally necessary to reclaim the yarn thereon for use.

The need to sort such spent bobbins according to these three categories is thus apparent. Conventional apparatus are available for separating empty bobbins and bobbins having a small amount of residual yarn thereon from bobbins having a large amount of residual yarn remaining thereon, such apparatus utilizing a plate or the like having an opening formed therein of a particular configuration and size so as to permit the passage therethrough of any bobbins having less than a predetermined amount of residual yarn wrapped thereabout while preventing the passage therethrough of bobbins having greater than such predetermined amount of yarn wrapped thereabout, and utilizing means such as a conveyor assembly for transporting and presenting bobbins to the plate opening. However no apparatus is known to exist for automatically sorting clean bobbins from bobbins having residual yarn wrapped thereabout, such process being presently and traditionally performed by hand.

In contrast with the above, the present invention provides a novel apparatus for sorting textile bobbins mechanically and automatically either into two groups comprised respectively of empty bobbins and bobbins having residual yarn thereon, or into three groups comprised respectively of empty bobbins, bobbins having less than a predetermined amount of residual yarn thereon and bobbins having greater than such predetermined amount of residual yarn thereon.

SUMMARY OF THE INVENTION

Briefly described, the present invention for sorting textile bobbins comprises sorting conveyor means having a yarn engaging surface and being arranged for upwardly inclined movement of the yarn engaging surface for upward conveyance and discharge therefrom of bobbins having residual yarn wrapped thereabout by engagement of the yarn by the yarn engaging surface and for downward sliding discharge therefrom of empty bobbins. Means are provided for driving the sorting conveyor means, and means are provided for feeding bobbins onto the sorting conveyor means.

In the preferred embodiment of the sorting apparatus of the present invention, the yarn engaging surface includes a plurality of yarn engaging projections extending from the sorting conveyor means, and preferably formed of card clothing having a plurality of projecting wire teeth inclined in the direction of upward movement of the yarn engaging surface. The sorting conveyor means preferably includes sorting belt means movable upwardly along an upper run extending from a lower end to an upper end for receiving bobbins on the upper run. The upper run is inclined sufficiently for sliding of empty bobbins downwardly therealong under the force of gravity and against the frictional forces created between the empty bobbins and the yarn engaging surface to fall from the lower end of the upper run, with the yarn engaging surface engaging bobbins having residual yarn wrapped thereabout to carry such bobbins upwardly along the upper run and against the force of gravity to fall from the upper end of the upper run.

Transporting conveyor means is preferably provided for feeding bobbins onto the sorting conveyor means and is disposed with respect to the sorting conveyor means to pass adjacent the sorting conveyor means and to be higher than the sorting conveyor means at the location of adjacency. In the preferred embodiment, the transporting conveyor means and the sorting conveyor means are disposed in closely adjacent, generally parallel relation with side wall means extending therebetween. The transporting conveyor means includes a plurality of bobbin engaging elements spaced longitudinally thereon at generally equal intervals and extending therefrom for engaging the bobbins for movement therewith in generally axial alignment with the longitudinal extent thereof.

In the preferred embodiment of the present invention for sorting empty bobbins from bobbins having residual yarn thereon, the side wall means is provided with an opening therein at the location of adjacency of the transporting conveyor means to the sorting conveyor means, the transporting conveyor means being oriented in cross-section at the location of adjacency at a downward incline toward the side wall means such that bobbins being transported along the transporting conveyor means move toward the side wall means and fall through the opening therein onto the sorting conveyor means. In such embodiment, the aforementioned bobbin engaging elements preferably extend across substantially the entire transverse extent of the transporting conveyor means. Such embodiment is uniquely adaptable for use with conventional textile bobbin stripping machines to sort the empty, stripped bobbins from those bobbins which the machine failed to properly strip, by providing means for transporting the bobbins discharged by such a machine to the bobbin feeding means of the sorting apparatus of the present invention and providing chute means for receiving bobbins having residual yarn thereon discharged from the sorting conveyor means and transporting such bobbins to a storage position for re-feeding to the stripping machine.

In the preferred embodiment of the present invention for sorting bobbins into the aforementioned three groups, the side wall means includes an opening therein of predetermined size at the location of adjacency of the transporting conveyor means to the sorting conveyor means to permit bobbins having less than a predetermined amount of residual yarn wrapped thereabout to fall through the opening onto the sorting conveyor means while preventing bobbins having greater than the predetermined amount of residual yarn wrapped thereabout from passing through the opening, such bobbins being conveyed by the transporting conveyor means to a discharge location. In this embodiment, the transporting conveyor means is oriented in cross-section along the longitudinal extent thereof at a downward incline toward the side wall means such that bobbins being transported along the transporting conveyor means will be maintained adjacent and transported along the side wall means. Additionally, the bobbin engaging elements in this embodiment are positioned on the transporting conveyor means adjacent the side wall means and are configured to each engage one bobbin and thereby convey the bobbins sequentially along the transporting conveyor means.

This latter preferred embodiment is especially adaptable for use with conventional textile yarn winding machines to sort the spent bobbins discharged therefrom into the aforedescribed three groups, by providing means for transporting to the transporting conveyor means the spent bobbins from which yarn has been unwound by the winding machine and providing collection chute means disposed at the discharge location of the transporting conveyor means for receiving bobbins having greater than the predetermined amount of residual yarn thereon and transporting such bobbins to a storage position for unwinding of the residual yarn therefrom by the winding machine.

DESCRIPTION OF THE PREFERRED EMBODIMENT

Referring now to the accompanying drawings, the bobbin sorting apparatus of the present invention is indicated generally at 20 and is illustrated in two preferred embodiments thereof, FIGS. 1–4 illustrating the use of the present bobbin sorting apparatus in combination with a textile bobbin stripping machine, indicated generally at 22, to sort the bobbins discharged from the stripping machine 22 into two groups comprised respectively of empty bobbins E having no residual yarn thereon and bobbins B which were not properly stripped and thus have residual yarn thereon, and FIGS. 6–14 illustrating the use of the present bobbin sorting apparatus in combination with a textile yarn winding machine, of which only the conveyor belts 24, which transport away from the winding machine the spent bobbins from which yarn has been unwound thereby, are illustrated, for sorting such spent bobbins into three groups comprised respectively of empty bobbins E, Bobbins B′ having less than a predetermined amount of yarn wrapped thereabout, and bobbins B″ having greater than a predetermined amount of yarn wrapped thereabout.

Figure 1:
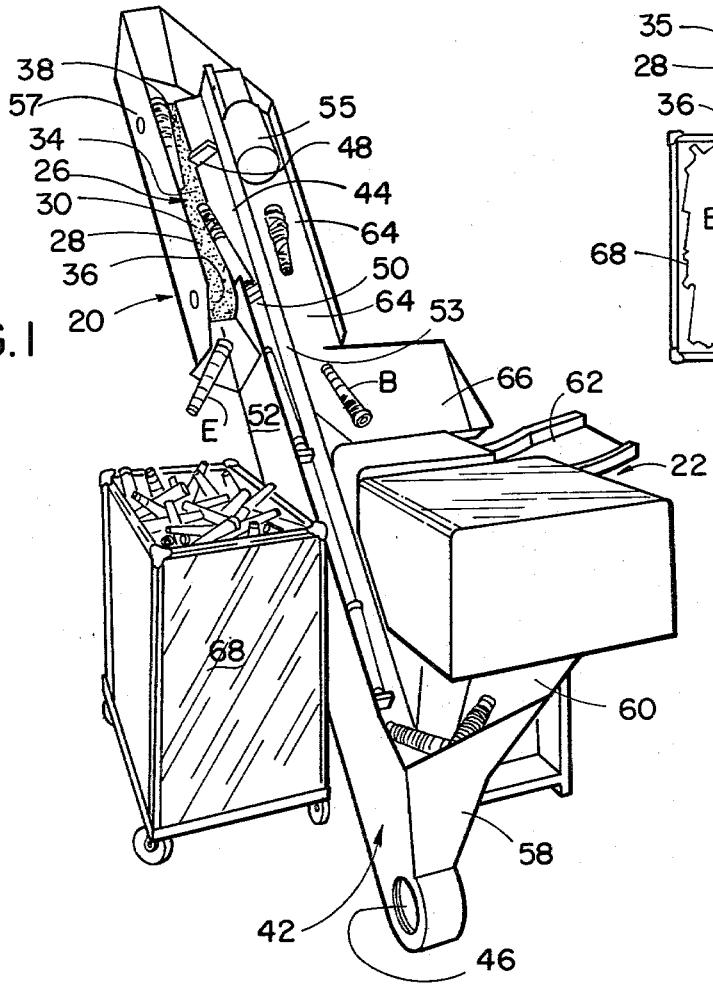
FIG. 1 is a perspective view of the preferred embodiment of the present invention arranged for use with a conventional textile bobbin stripping machine to sort bobbins discharged therefrom into groups respectively comprised of empty bobbins and bobbins having residual yarn thereon.
Figure 2:
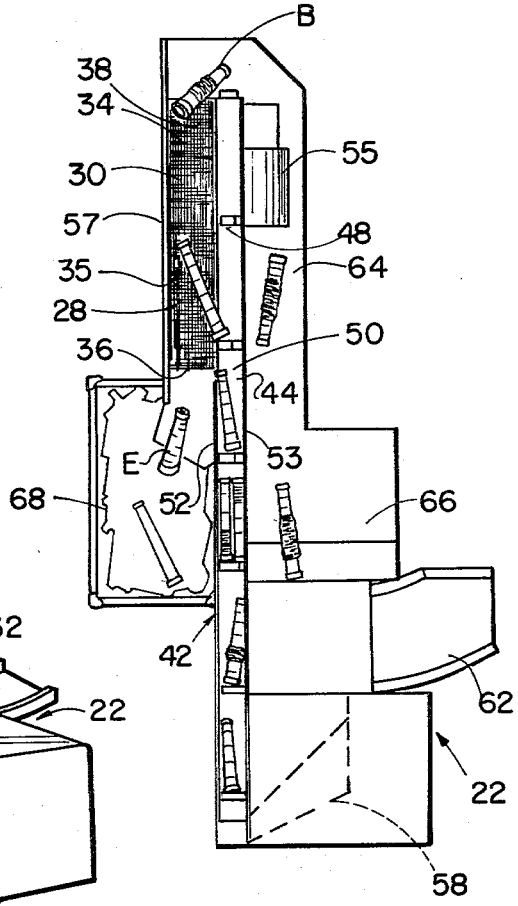
FIG. 2 is a plan view of the apparatus of FIG. 1.
Figure 3:
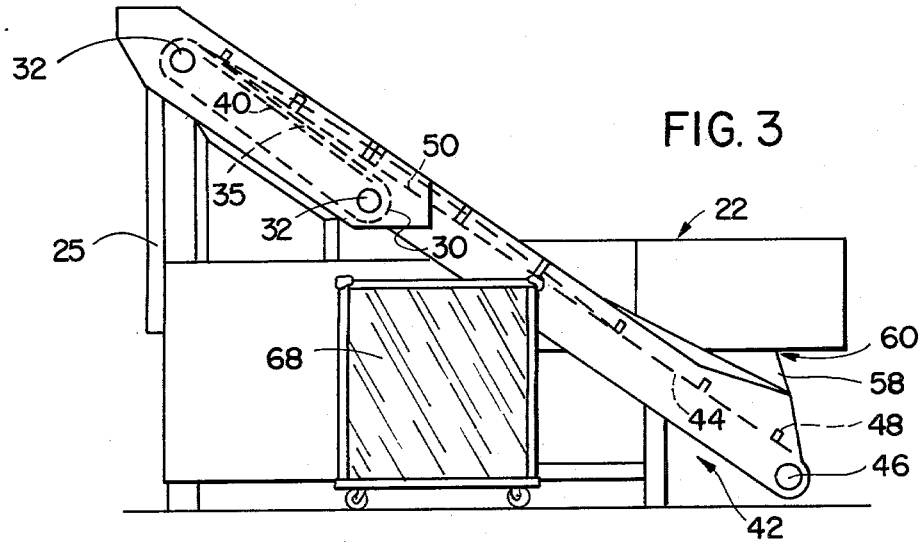
FIG. 3 is a left side elevational view of the apparatus of FIG. 1.
Figure 4:
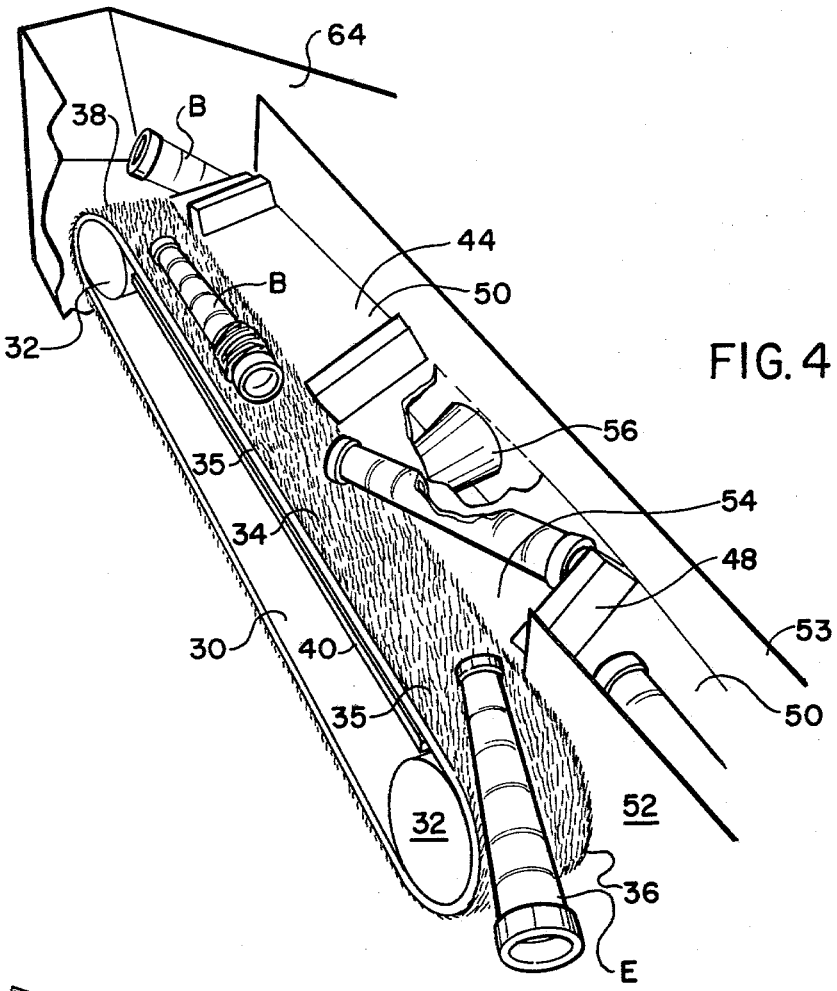
FIG. 4 is an enlarged perspective view of the sorting conveyor means and the transporting conveyor means at the location of adjacency therebetween.
Figure 5:
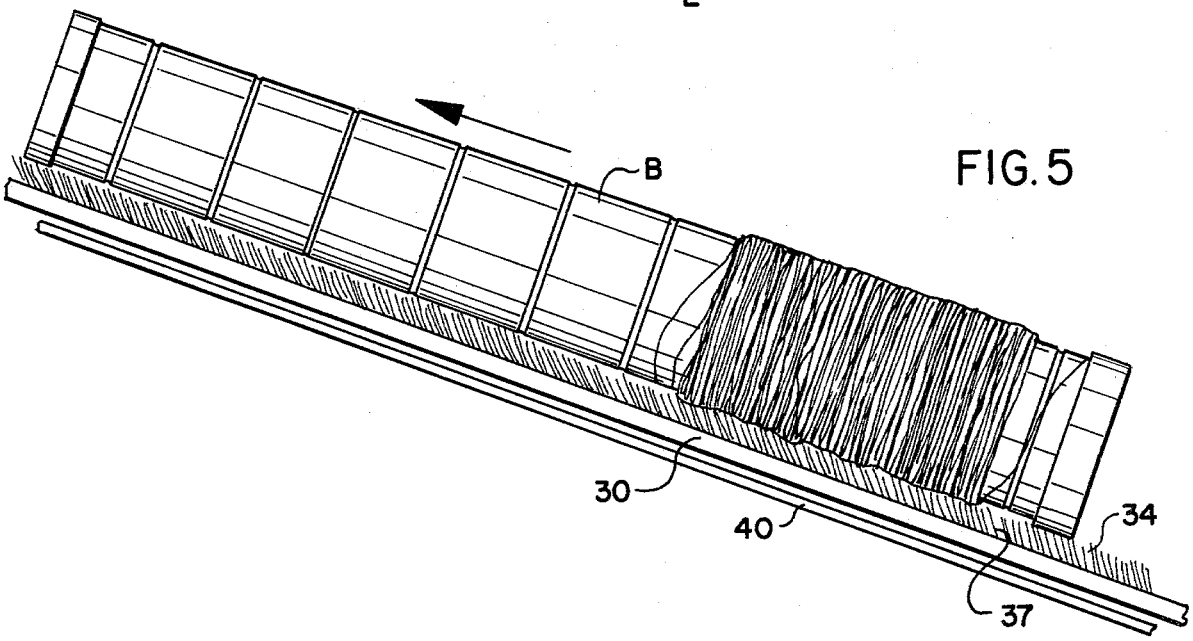
FIG. 5 is a detailed sectional view taken along line 5—5 of FIG. 4 showing the teeth of the sorting conveyor belt engaging the residual yarn on a bobbin.
Figure 6:
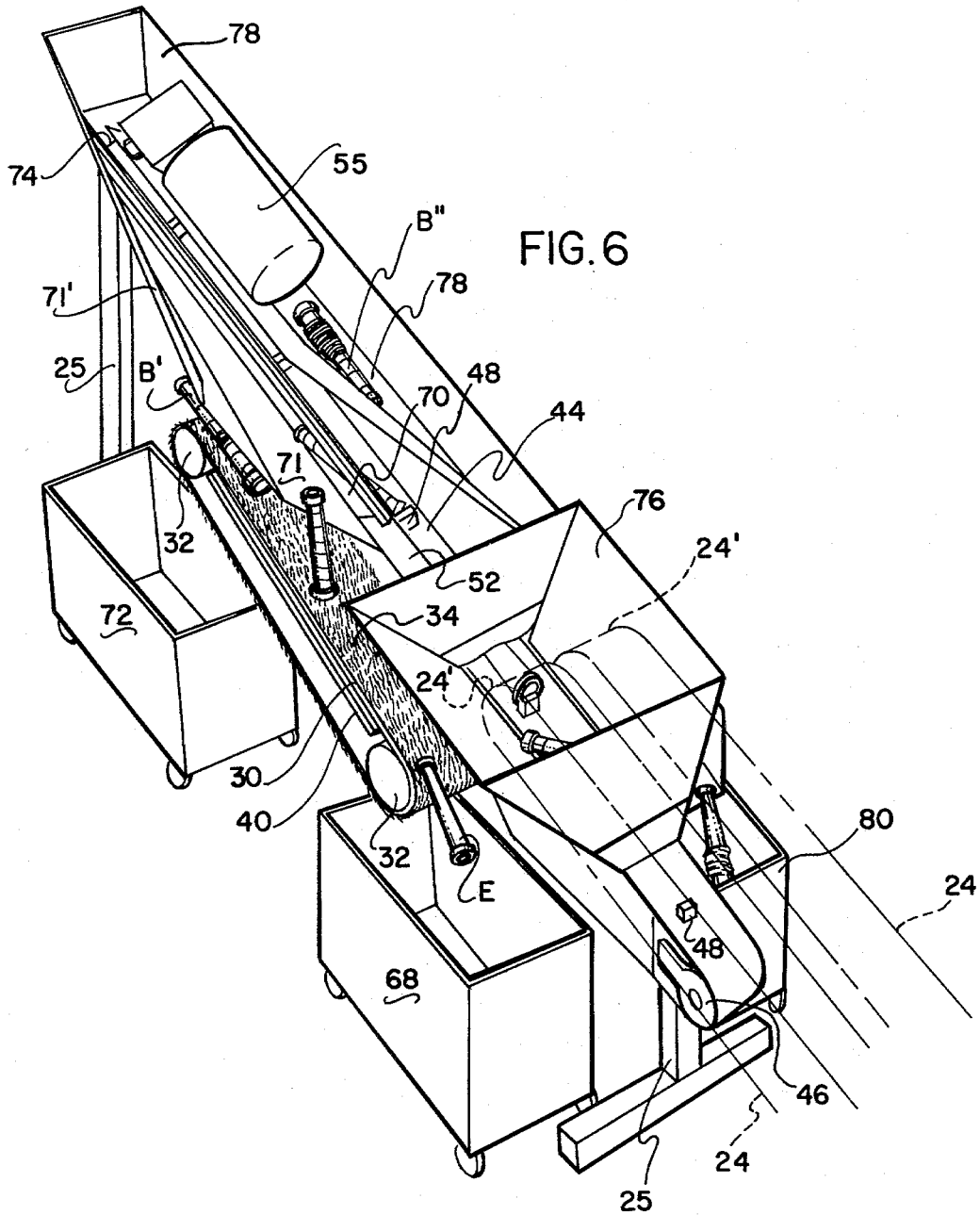
FIG. 6 is a perspective view of the preferred embodiment of the present invention arranged for use with a conventional textile yarn winding machine to sort bobbins discharged therefrom into groups comprised respectively of empty bobbins, bobbins having less than a predetermined amount of residual yarn thereon and bobbins having greater than such predetermined amount of residual yarn wrapped thereabout.
Figure 7:
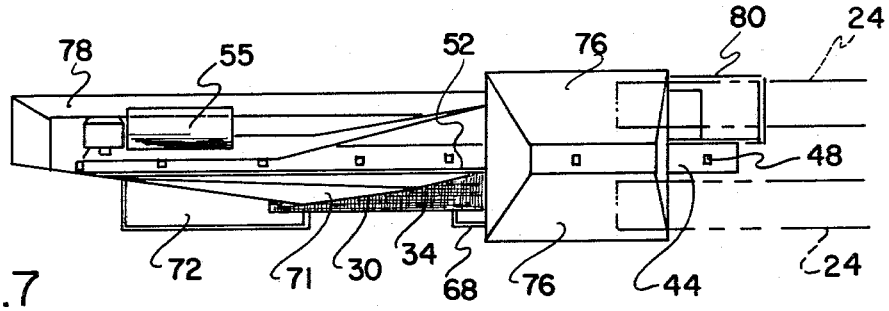
FIG. 7 is a plan view of the apparatus of FIG. 6.
Figure 8:
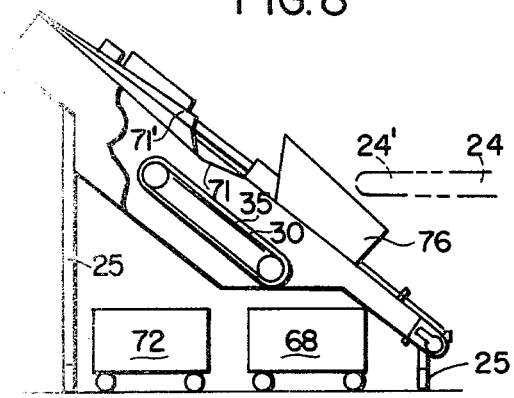
FIG. 8 is a left side elevational view of the apparatus of FIG. 6.
Figure 9:
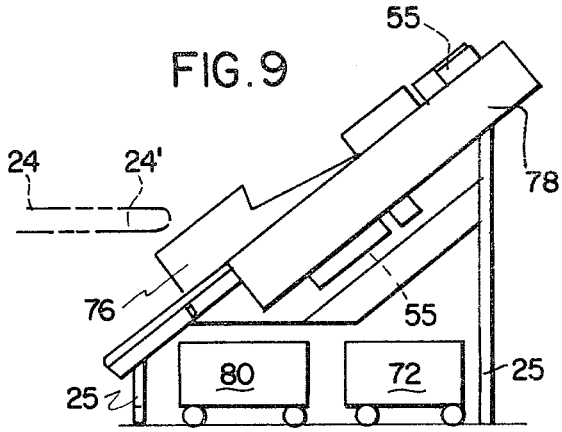
FIG. 9 is a right side elevational view of the apparatus of FIG. 6.
Figure 10:
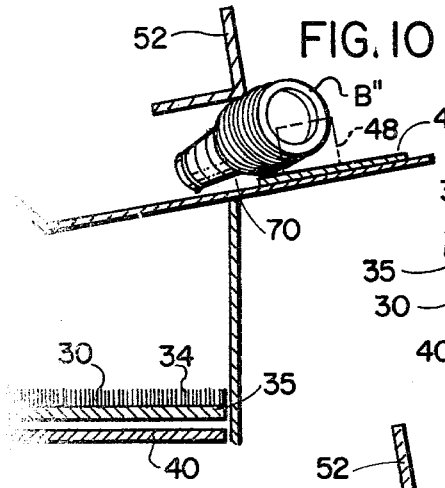
FIG. 10 is a vertical sectional view taken along line 10—10 of FIG. 7 and illustrating the opening in the side wall of the transporting conveyor means preventing a bobbin having greater than a predetermined amount of residual yarn thereon from passing through the opening.
Figure 11:
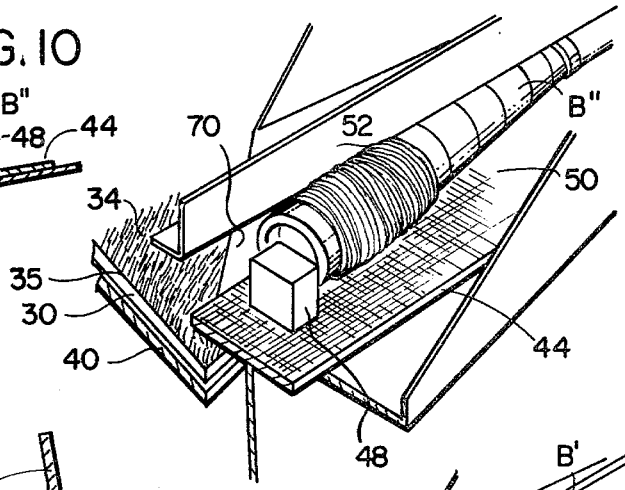
FIG. 11 is a perspective view illustrating the occurrence of FIG. 10.
Figure 12:
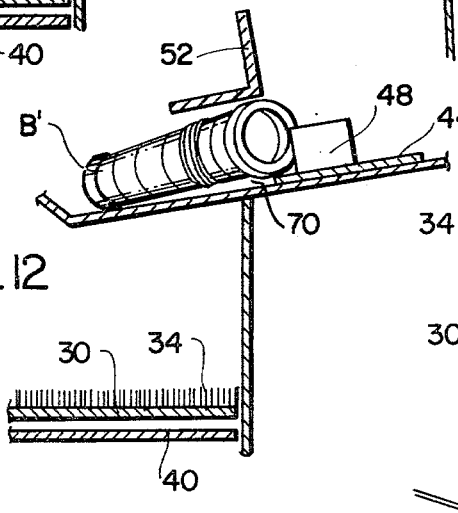
FIG. 12 is a vertical sectional view similar to FIG. 10 but illustrating a bobbin having less than the predetermined amount of yarn thereon passing through the side wall opening.
Figure 13:
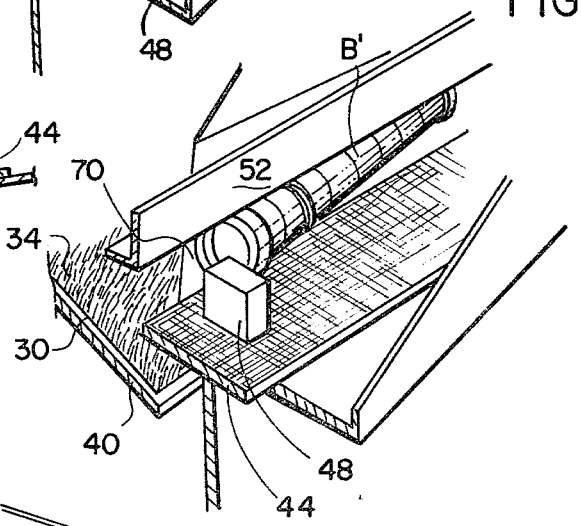
FIG. 13 is a perspective view similar to FIG. 11, illustrating the occurrence of FIG. 12.
Figure 14:
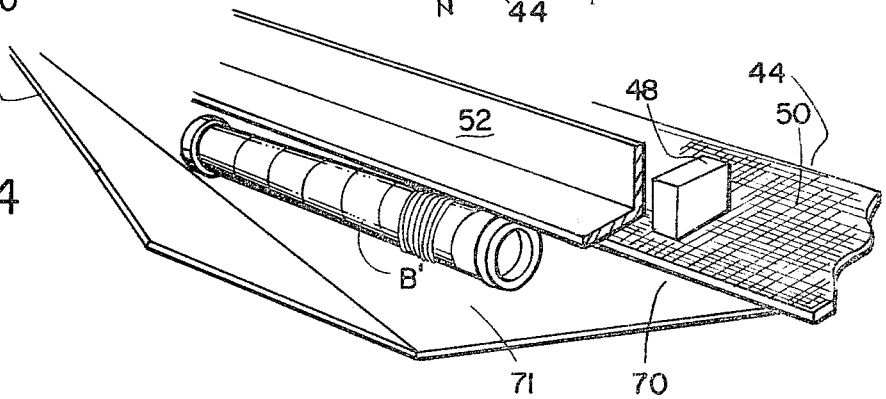
FIG. 14 is another perspective view of the occurrence of FIG. 12 taken from a different perspective than FIG. 13.
Figure 1:
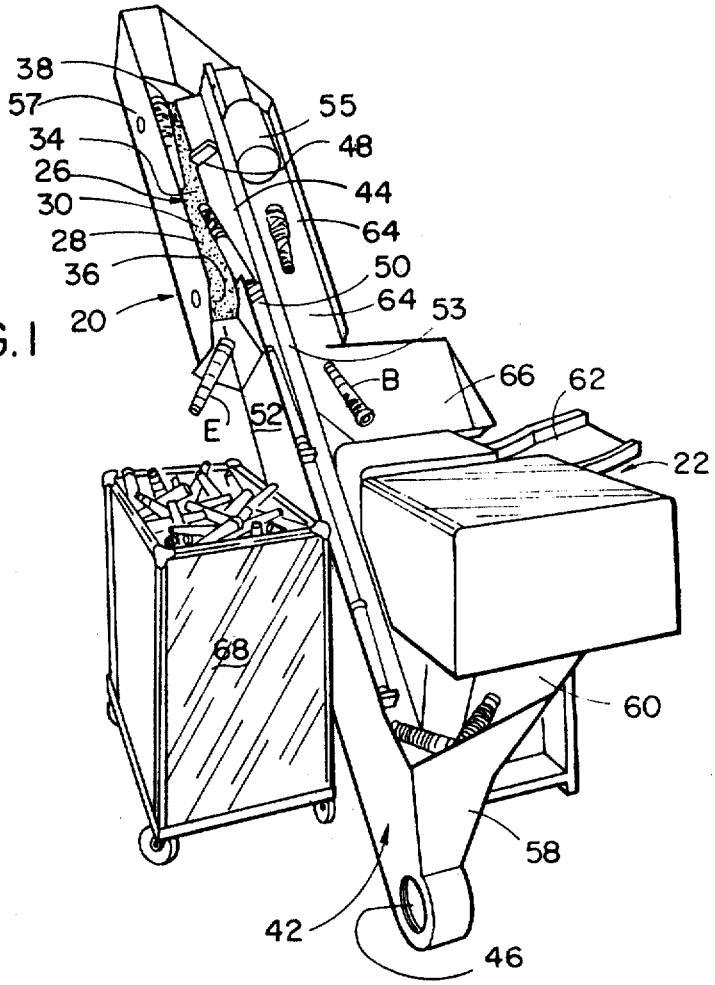

The bobbin sorting apparatus 20 of the present invention is supported by a machine frame 25 and basically comprises a sorting conveyor assembly, indicated generally at 26, which includes a sorting belt arrangement 28, having an endless sorting conveyor belt 30 trained about two pulleys 32 rotatably mounted on the frame 25. The conveyor belt 30 is provided with a yarn engaging surface 34 including a plurality of yarn engaging projections 37 extending from the belt 30 on the outwardly facing side thereof and being engagable with the residual yarn on bobbins B having residual yarn remaining thereon (FIG. 5), and is disposed, by appropriate location of the pulleys 32 on the machine frame 25, at an incline for upwardly inclined movement of the belt 30 to move the yarn engaging surface 34 thereof along an upper belt run 35 extending from a lower end 36 to an upper end 38 for receiving bobbins on the upper run 35, the inclined disposition of the upper run 35 being sufficient for sliding of empty bobbins E downwardly therealong under the force of gravity and against the frictional forces created between the empty bobbins E and the yarn engaging surface 34 to fall from the lower end 36 of the upper run 35, with the yarn engaging surface 34 engaging the residual yarn on bobbins B having residual yarn wrapped thereabout to carry such bobbins B upwardly along the upper run 35 and against the force of gravity to fall from the upper end 38 of the upper run 35. Preferably, the sorting conveyor belt 30 is a conventional belt utilized on carding machines and comprises card clothing, including a plurality of projecting wire teeth 37 inclined in the direction of upward movement of the belt 30 along the upper run 35. To cause the sorting belt 30 to move in a linear path along the upper run 35 thereof and prevent its bowing therealong under the stress of its weight and the weight of bobbins thereon, a rigid plate 40 is affixed to the frame 25 immediately beneath and extending along the upper run 35, thereby enhancing the frictional engaging contact between the teeth 37 of the yarn engaging surface 34 and the residual yarn of bobbins B having residual yarn thereon.

In each preferred embodiment of the present invention, means are also provided for feeding bobbins onto the upper run 35 of the sorting conveyor belt 30, a transporting conveyor assembly, generally indicated at 42, being provided for this purpose. It is generally preferred that the transporting conveyor assembly 42 pass adjacent to the sorting conveyor assembly 26 and be higher than the sorting conveyor assembly 26 at the location of adjacency for transporting bobbins to the location of adjacency and depositing the bobbins thereat in a manner hereinafter described onto the upper run 35 of the sorting belt 30 of the sorting conveyor assembly 26. Thus, in the preferred embodiments of the present invention, the transporting conveyor assembly 42 includes an inclined transporting conveyor belt 44 trained about two pulleys 46 for upward movement of the belt 44 along an upper run 50, and is disposed in closely adjacent, generally parallel relation with the sorting conveyor belt 30. A plurality of bobbin engaging elements 48 are affixed to the outwardly facing side of the transporting belt 44 at generally equal spacings along the longitudinal extent thereof and extend therefrom for engaging bobbins to move them along the upper run 50 of the transporting belt 44. The transporting conveyor assembly 42 also includes generally closely spaced side walls 52, 53 extending along opposite sides of the belt 44 to maintain the bobbins being transported thereby on the upper run 50 thereof in generally axial alignment with the longitudinal extent thereof for feeding onto the sorting belt 30 in such disposition. Means are provided for driving one of the pulleys 32 and 46 of each conveyor belt 30 and 44 to effect upward movement of each belt 30 and 44 along its respective upper run 35 and 50, such driving means preferably comprising one or more conventional electric motors.

As hereinbefore indicated, the above-described sorting apparatus may be utilized to separate empty bobbins E from bobbins B having residual yarn thereon, an embodiment of the present invention designed for such use being illustrated in FIGS. 1–4 in combination with a textile bobbin stripping machine 22. In such an embodiment of the present invention, the upper pulley 32 about which the sorting conveyor belt 30 is trained and the upper pulley 46 about which the transporting conveyor belt 44 is trained are of approximately equal diameter and are coaxially affixed for unitary driving of their respective conveyor belts 30 and 44, a single electric motor 55 being provided for driving rotation of the upper pulleys 32 and 46 to effect upward movement of the belts 30 and 44 along their respective upper runs 35 and 50 at approximately equal longitudinal speeds. The respective other pulleys 32 and 46 of the sorting and transporting conveyor assemblies 26 and 42 are arranged on the frame 25 such that the sorting conveyor belt 30 extends upwardly at a slightly steeper incline than does the transporting conveyor belt 44. In this manner, the upper run 50 of the transporting conveyor belt 44 extends generally alongside and slightly above the upper run 35 of the sorting belt 30.

The transporting conveyor assembly 42 in this embodiment also includes side walls 52, 53 extending along opposite sides of the belt 44 to maintain the bobbins being transported thereby on the upper run 50 thereof in generally axial alignment therewith. The side wall 52 extends between the transporting and sorting conveyor assemblies 42 and 26, respectively, and is provided with an opening 54 formed therein at the location of adjacency of the transporting conveyor assembly 42 and the sorting conveyor assembly 26 between the respective upper runs 50 and 35 of the conveyor belts 44 and 30 thereof. The transporting conveyor assembly 42 includes a cam surface 56 affixed to the machine frame 25 immediately beneath the upper run 50 of the transporting conveyor belt 44 at the location of adjacency of the transporting conveyor assembly 42 and the sorting conveyor assembly 26 and extending upwardly in engagement with the underside of the upper run 50 to tilt the upper run 50 transversely and thereby orient the upper run 50 in transverse cross-section at a downward incline toward the side wall 52 such that bobbins being transported along the transporting conveyor belt 44 move or roll toward the sidewall 52 and pass through the opening 54 therein onto the sorting conveyor belt 30 for sorting thereof in the above-described manner. A side wall 57 extends along the upper run 35 of the sorting conveyor belt 30 to prevent bobbins fed onto the upper run 35 from the transporting conveyor belt 44 from continuing to roll and falling from the side of the upper run 35. The bobbin engaging elements 48 of the transporting conveyor belt 44 in this embodiment preferably extend across substantially the entire transverse extent thereof, and thus it may happen that one or more bobbins may be engaged and transported upwardly along the upper run 50 by one of the engaging elements 48 for deposition through the opening 54 onto the upper run 35 of the sorting conveyor belt 30, this embodiment of the sorting apparatus of the present invention being capable of effectively sorting bobbins even when receiving more than one bobbin at a time.

To facilitate the use of this embodiment of the present invention with a textile yarn stripping machine 22, means are provided for transporting and feeding bobbins discharged by the stripping machine 22 to the transporting conveyor belt 44 for conveyance thereof to the location of adjacency of the sorting conveyor assembly 26 and the transporting conveyor assembly 42. As can best be seen in FIG. 1, a discharge chute 58 extending from the bobbin discharge location, indicated generally at 60, of the bobbin stripping machine 22 to the lower end of the transporting conveyor belt 44 is provided for this purpose. To return the bobbins B discharged from the stripping machine 22 with residual yarn remaining thereon to the feeding location 62 for re-feeding thereof to the stripping machine 22, a bobbin return chute 64 is provided, extending from immediately below the upper end 38 of the upper run 35 of the sorting conveyor belt 30 to a bobbin storage location 66 adjacent the bobbin feeding location 62 of the stripping machine 22. A storage bin 68 is located below the lower end 36 of the upper run 35 of the sorting conveyor belt 30 to receive and collect the empty bobbins E falling from the lower end 36 of the upper run 35.

As hereinbefore mentioned, the above-described sorting apparatus may also be utilized to separate bobbins into three groups comprised respectively of empty bobbins E, bobbins B' having less than a predetermined amount of residual yarn thereon and bobbins B" having greater than a predetermined amount of residual yarn thereon, an embodiment of the present invention designed for such use being illustrated in FIGS. 6–14 in combination with a conventional textile winding machine. Side walls 52 and 53 are also provided in this embodiment adjacent opposite sides of the transporting conveyor belt 44, the side wall 52 being provided with an opening 70 of a predetermined size and shape at the location of adjacency of the transporting conveyor assembly 42 and the sorting conveyor assembly 26 between the respective upper runs 50 and 35 of the conveyor belts 44 and 30 thereof, the size and shape of the opening 70 being selected according to the size and shape of the bobbins being sorted to permit empty bobbins E and bobbins B' having less than a predetermined amount of yarn remaining thereon to pass therethrough but to prevent passage therethrough of bobbins B" having greater than such predetermined amount of residual yarn. The pulleys 46 about which the transporting conveyor belt 44 are trained are arranged to rotate about inclined axes such that the upper run 50 of the transporting conveyor belt 44 is oriented in transverse cross-section along the entire longitudinal extent thereof at a downward incline toward the side wall 52 such that bobbins transported along the upper run 50 are maintained at and move upwardly along the side wall 52. In this manner, empty bobbins E and bobbins B' having less than the predetermined amount of residual yarn remaining thereon being transported along the upper run 50 of the transporting conveyor belt 44 roll through the opening 70 in the side wall 52 upon reaching the point of adjacency between the sorting and transporting conveyor assemblies 26 and 42, respectively, onto the sorting conveyor belt 30 (FIGS. 12–14), and are sorted in the above-described manner, the empty bobbins E sliding downwardly along the upper run 35 and falling from the lower end 36 thereof into a storage bin 68 and the bobbins B' with residual yarn thereon being transported upwardly by the sorting belt 30 and falling from the upper end 38 thereof into a separate storage bin 72. A side wall 57 is also provided in this embodiment adjacent the upper run 35 of the sorting conveyor belt 30 and is cooperable with the side wall 52 to maintain bobbins E and B' fed to the sorting belt 30 on the upper run 35 thereof and to prevent such bobbins from falling from the side thereof. The excessive residual yarn on bobbins B" having greater than the predetermined amount of yarn thereon engages the portion of the side wall 52 surrounding the opening 70 and is thereby prevented from passing therethrough (FIGS. 10 and 11), such bobbins B" being transported upwardly along the upper run 50 of the transporting conveyor belt 44 past the opening 70 to a discharge location 74 at the upper end of the belt 44.

It has been found that, since the excessive amount of residual yarn on bobbins B" having greater than the predetermined amount of residual yarn thereon is often concentrated in one location along the length of the bobbin, usually at one end thereof, the ends of such bobbins B" having little or no yarn wrapped thereabout will extend through the opening 70 upon reaching such location along the upper run 50 of the transporting belt 44. If the respective upper runs 35 and 50 of the sorting and transporting belts 30 and 44 are disposed generally alongside one another as in the above-described embodiment, such bobbins B" may therefore be engaged by the teeth 37 of the engaging surface 34 of the sorting conveyor belt 30 upon extension through the opening 70, possibly resulting in a jamming of the opening 70. To prevent this occurrence in this embodiment, the pulleys 32 about which the sorting belt 30 is trained are disposed on the machine frame 25 such that the upper run 35 of the belt 30 extends along the side wall 52 at a relatively short spacing below the opening 70 and the upper run 50 of the transporting conveyor belt 44, whereby contact between the sorting belt 30 and the ends of any bobbins B" extending through the spring 70 is prevented. A directional chute 71 is affixed to the side wall 52 on the side thereof opposite the transporting conveyor belt 44 and immediately below the opening 70 to direct the bobbins E and B' passing through the opening 70 onto the sorting belt 30, such bobbins E and B' sliding along the chute 71 and falling therefrom a short distance onto the sorting conveyor belt 30. The directional chute 71 includes a wall 71' extending angularly upwardly toward and merging with the side wall 52 at the upward end of the opening 70 for engaging the ends of bobbins B" extending through the opening 70 as such bobbins B" are conveyed upwardly by the transporting conveyor belt 44 to thereby direct and return such ends of the bobbins B" through the opening 70 onto the belt 44 for conveyance to the discharge location 74. Because of the distance which bobbins E and B' must fall to the sorting belt 30, such bobbins may tend to rebound off the upper run 35 thereof upon feeding thereto. The aforementioned side wall 57 thus serves the additional purpose in this embodiment of preventing such bobbins E and B' from uncontrolledly rebounding off the upper run 35 upon feeding thereto.

As a result of the relative dispositions of the pulleys 32 of the sorting belt 30 and the pulleys 46 of the transporting conveyor belt 44 in this embodiment, separate electric drive motors 55 are operably associated respectively with the upper pulleys 32 and 46 of the belts 30 and 44 to actuate driving rotation of such pulleys 32 and 46 to effect upward movement of the belts 30 and 44 along their respective upper runs 35 and 50. Preferably, the two electric motors 55 are operated such that the belts 30 and 44 move at approximately equal longitudinal speeds, although differing speeds and different combinations of speeds may also be utilized.

As will be understood by those skilled in the art, since the opening 70 in this embodiment prevents the passage therethrough of bobbins B" having greater than a predetermined amount of yarn thereon, the upward conveyance of more than one bobbin by any one bobbin engaging element 48 will result in empty bobbins E or bobbins B' having less than the predetermined amount of yarn thereon being conveyed upwardly with the bobbins B″ having greater than the predetermined amount of yarn whenever an empty bobbin E or bobbin B′ having less than the predetermined amount of yarn is engaged and conveyed by one of the elements 48 with a bobbin B″ having greater than such predetermined amount of yarn with the latter bobbin B″ disposed intermediate the side wall 52 and the empty bobbin E or bobbin B′. To prevent this, it is preferred that bobbins be conveyed sequentially along the upper run 50 of the transporting conveyor belt 44. Thus in this preferred embodiment of the present invention, the bobbin engaging elements 48 are disposed on the transporting conveyor belt 44 adjacent the side wall 52 and are configured to each engage only one bobbin, whereby the bobbins to be sorted are transported sequentially along the upper run 50.

To facilitate the use of this embodiment of the present invention with a textile yarn winding machine, means are provided for transporting to the transporting conveyor belt 44 spent bobbins from which yarn has been unwound by the winding machine. Conventional winding machines, as those skilled in the art will understand, utilize one or more conveyors 24 to transport away from the winding machine such spent bobbins. Thus, for the aforementioned transporting purpose, a chute or hopper 76 is disposed immediately below the discharge end or ends 24′ of the conveyors 24 and extends therefrom to the lower end of the transporting conveyor belt 44 to receive the spent bobbins discharged by the winding machine and direct them onto the upper run 50 of the transporting conveyor belt 44. Additionally, a collection chute 78 is disposed immediately below the discharge location 74 at the upper end of the transporting belt 44 and extends therefrom downwardly for receiving from the belt 44 bobbins B″ having greater than the predetermined amount of yarn thereon and transporting such bobbins B″ to a storage bin 80 for subsequent unwinding of the residual yarn therefrom.

The present apparatus for sorting textile bobbins has been herein described and illustrated with regard to its preferred embodiments and with regard to two specifically contemplated embodiments thereof. However, as those skilled in the art will readily understand, modifications and variations may be resorted to without departing from the substance or scope of the present invention. Such modifications and variations are within the scope of the present invention, which is intended to be limited only by the appended claims and equivalents thereof.

I claim:

1. An apparatus for sorting textile bobbins into groups comprises respectively of empty bobbins and bobbins having residual yarn wrapped thereabout, comprising:

(a) sorting conveyor means having a yarn engaging surface and being arranged for upwardly inclined movement of said yarn engaging surface for upward conveyance and discharge therefrom of bobbins having residual yarn wrapped thereabout by engagement of the yarn by said yarn engaging surface and for downward sliding discharge therefrom of empty bobbins, (b) means for driving said sorting conveyor means, and (c) means for feeding bobbins onto said sorting conveyor means including transporting conveyor means passing closely adjacent said sorting conveyor means and being higher than said sorting conveyor means at the location of adjacency for transporting bobbins to the location of adjacency and depositing said bobbins at said location onto said sorting conveyor means, bobbins being carried on said transporting conveyor means in generally axial alignment with the longitudinal extent thereof, said bobbin feeding means including side wall means extending between said transporting conveyor means and said sorting conveyor means, said side wall means having an opening therein at the location of adjacency of said transporting conveyor means to said sorting conveyor means, and said transporting conveyor means being oriented in cross-section at the location of adjacency thereof to said sorting belt means at a downward incline toward said side wall means such that bobbins being transported along said transporting conveyor means move toward said side wall means and fall through said opening therein onto said sorting conveyor means.

2. An apparatus for sorting textile bobbins according to claim 1 and characterized further in that said sorting conveyor means includes sorting belt means movable upwardly along an upper run extending from a lower end to an upper end for receiving bobbins on said upper run, said upper run being inclined sufficiently for sliding of empty bobbins downwardly therealong under the force of gravity and against the frictional forces created between said empty bobbins and said yarn engaging surface to fall from said lower end of said upper run, with said yarn engaging surface engaging the residual yarn on bobbins having residual yarn wrapped thereabout to carry said bobbins with residual yarn thereon upwardly along said upper run and against the force of gravity to fall from said upper end of said upper run.

3. An apparatus for sorting textile bobbins according to claim 1 and characterized further in that said yarn engaging surface includes a plurality of yarn engaging projections extending from said sorting conveyor means.

4. An apparatus for sorting textile bobbins according to claim 3 and characterized further in that said yarn engaging surface comprises card clothing, including a plurality of projecting wire teeth inclined in the direction of upward movement of said yarn engaging surface.

5. An apparatus for sorting textile bobbins according to claim 1 and characterized further in that said transporting conveyor means includes a plurality of bobbin engaging elements spaced longitudinally thereof at generally equal intervals and extending therefrom for engaging said bobbins for movement with said transporting conveyor means.

6. An apparatus for sorting textile bobbins according to claim 5 and characterized further in that each said bobbin engaging element extends across substantially the entire transverse extent of said transporting conveyor means.

7. An apparatus for sorting textile bobbins according to claim 1 and characterized further in that said sorting conveyor means includes sorting belt means movable upwardly along an upper run extending from a lower end to an upper end for receiving bobbins on said upper run, said upper run being inclined sufficiently for sliding of empty bobbins downwardly therealong under the force of gravity and against the frictional forces created between said empty bobbins and said yarn engaging surface to fall from said lower end of said upper run, with said yarn engaging surface engaging the residual yarn on bobbins having residual yarn wrapped thereabout to carry said bobbins with residual yarn thereon upwardly along said upper run and against the force of gravity to fall from said upper end of said upper run.

8. An apparatus for sorting textile bobbins according to claim 1 and characterized further in that said yarn engaging surface comprises card clothing, including a plurality of projecting wire teeth inclined in the direction of upward movement of said yarn engaging surface.

9. An apparatus for sorting textile bobbins according to claim 1 and characterized further in that said sorting conveyor means and said transporting conveyor means pass in generally parallel relation.

10. In an apparatus for stripping residual yarn from textile bobbins or the like, the improvement comprising:

(a) means for sorting textile bobbins into groups comprised respectively of empty bobbins and bobbins having residual yarn wrapped thereabout, said sorting means including (i) sorting conveyor means having a yarn engaging surface and being arranged for upwardly inclined movement of said yarn engaging surface for upward conveyance and discharge therefrom of bobbins having residual yarn wrapped thereabout by engagement of the yarn by said yarn engaging surface and for downward sliding discharge thereform of empty bobbins, (ii) means for driving said sorting conveyor means, and (iii) means for feeding bobbins onto said sorting conveyor means including transporting conveyor means passing closely adjacent said sorting conveyor means and being higher than said sorting conveyor means at the location of adjacency for transporting bobbins to the location of adjacency and depositing said bobbins at said location onto said sorting conveyor means, bobbins being carried on said transporting conveyor means in generally axial alignment with the longitudinal extent thereof, said bobbin feeding means including side wall means extending between said transporting conveyor means and said sorting conveyor means, said side wall means having an opening therein at the location of adjacency of said transporting conveyor means to said sorting conveyor means, and said transporting conveyor means being oriented in cross-section at the location of adjacency thereof to said sorting belt means at a downward incline toward said side wall means such that bobbins being transported along said transporting conveyor means move toward said side wall means and fall through said opening therein onto said sorting conveyor means;

(b) means for transporting bobbins discharged by said stripping apparatus to said bobbin feeding means of said sorting means; and (c) chute means for receiving bobbins having residual yarn thereon discharged from said sorting conveyor means and transporting said bobbins having residual yarn to a storage position for re-feeding to said stripping apparatus.

11. In an apparatus for stripping residual yarn from textile bobbins or the like, the improvement of claim 10 and characterized further in that said sorting conveyor means includes sorting belt means movable upwardly along an upper run extending from a lower end to an upper end for receiving bobbins on said upper run, said upper run being inclined sufficiently for sliding of empty bobbins downwardly therealong under the force of gravity and against the frictional forces created between said empty bobbins and said yarn engaging surface to fall from said lower end of said upper run, with said yarn engaging surface engaging the residual yarn on bobbins having residual yarn wrapped thereabout to carry said bobbins with residual yarn thereon upwardly along said upper run and against the force of gravity to fall from said upper end of said upper run.

12. In an apparatus for stripping residual yarn from textile bobbins or the like, the improvement of claim 10 and characterized further in that said yarn engaging surface includes a plurality of yarn engaging projections extending from said sorting conveyor means.

13. In an apparatus for stripping residual yarn from textile bobbins or the like, the improvement of claim 12 and characterized further in that said yarn engaging surface comprises card clothing, including a plurality of projecting wire teeth inclined in the direction of upward movement of said yarn engaging surface.

14. In an apparatus for stripping residual yarn from textile bobbins or the like, the improvement of claim 10 and characterized further in that said transporting conveyor means includes a plurality of bobbin engaging elements spaced longitudinally thereon at generally equal intervals and extending therefrom for engaging said bobbins for movement with said transporting conveyor means.

15. In an apparatus for stripping residual yarn from textile bobbins or the like, the improvement of claim 14 and characterized further in that each said bobbin engaging element extends across substantially the entire transverse extent of said transporting conveyor means.

16. In an apparatus for stripping residual yarn from textile bobbins or the like the improvement of claim 10 and characterized further in that said sorting conveyor means includes sorting belt means movable upwardly along an upper run extending from a lower end to an upper end for receiving bobbins on said upper run, said upper run being inclined sufficiently for sliding of empty bobbins downwardly therealong under the force of gravity and against the frictional forces created between said empty bobbins and said yarn engaging surface to fall from said lower end of said upper run, with said yarn engaging surface engaging the residual yarn on bobbins having residual yarn wrapped thereabout to carry said bobbins with residual yarn thereon upwardly along said upper run and against the force of gravity to fall from said upper end of said upper run.

17. In an apparatus for stripping residual yarn from textile bobbins or the like, the improvement of claim 10 and characterized further in that said yarn engaging surface comprises card clothing, including a plurality of projecting wire teeth inclined in the direction of upward movement of said yarn engaging surface.

18. In an apparatus for stripping residual yarn from textile bobbins or the like, the improvement of claim 10 and characterized further in that said sorting conveyor means and said transporting conveyor means pass in generally parallel relation.

19. An apparatus for sorting textile bobbins into groups comprised respectively of empty bobbins, bobbins having less than a predetermined amount of residual yarn wrapped thereabout, and bobbins having greater than said predetermined amount of residual yarn wrapped thereabout, comprising:

(a) sorting conveyor means having a yarn engaging surface and being arranged for upwardly inclined movement of said yarn engaging surface for upward conveyance and discharge therefrom of bobbins having residual yarn wrapped thereabout by engagement of the yarn by said yarn engaging surface and for downward sliding discharge therefrom of empty bobbins, and (b) means for feeding bobbins onto said sorting conveyor means, said feeding means including transporting conveyor means passing adjacent said sorting conveyor means and being higher than said conveyor means at the location of adjacency for transporting bobbins along said transporting conveyor means and including side wall means extending between said sorting conveyor means and said transporting conveyor means, said side wall means including an opening therein of predetermined size at the location of adjacency of said transporting conveyor means to said sorting conveyor means to permit bobbins having less than a predetermined amount of residual yarn wrapped thereabout to fall through said opening onto said sorting conveyor means while preventing bobbins having greater than said predetermined amount of residual yarn wrapped thereabout from passing through said opening, such bobbins being conveyed by said transporting conveyor means to a discharge location.

20. An apparatus for sorting textile bobbins according to claim 19 and characterized further in that said sorting conveyor means includes sorting belt means movable upwardly along an upper run extending from a lower end to an upper end for receiving bobbins on said upper run, said upper run being inclined sufficiently for sliding of empty bobbins downwardly therealong under the force of gravity and against the frictional forces created between said empty bobbins and said yarn engaging surface to fall from said lower end of said upper run, with said yarn engaging surface engaging the residual yarn on bobbins having residual yarn wrapped thereabout to carry said bobbins with residual yarn thereon upwardly along said upper run and against the force of gravity to fall from said upper end of said upper run.

21. An apparatus for sorting textile bobbins according to claim 19 and characterized further in that said yarn engaging surface includes a plurality of yarn engaging projections extending from said sorting conveyor means.

22. An apparatus for sorting textile bobbins according to claim 21 and characterized further in that said yarn engaging surface comprises card clothing, including a plurality of projecting wire teeth inclined in the direction of upward movement of said yarn engaging surface.

23. An apparatus for sorting textile bobbins according to claim 19, 20 or 22 and characterized further in that said sorting conveyor means and said transporting conveyor means are disposed in closely adjacent, generally parallel relation, in that bobbins are carried on said transporting conveyor means in generally axial alignment with the longitudinal extent thereof, and in that said transporting conveyor means is oriented in cross-section along the longitudinal extent thereof at a downward incline toward said side wall means such that bobbins being transported along said transporting conveyor means are maintained adjacent and are transported along said side wall means.

24. An apparatus for sorting textile bobbins according to claim 23 and characterized further in that said transporting conveyor means includes a plurality of bobbin engaging elements spaced longitudinally thereon at generally equal intervals and extending therefrom for engaging said bobbins for movement with said transporting conveyor means.

25. An apparatus for sorting textile bobbins according to claim 24 and characterized further in that said bobbin engaging elements are positioned on said transporting conveyor means adjacent said side wall means and are configured to each engage one bobbin, whereby said bobbins are transported sequentially along said transporting conveyor means.

26. In an apparatus for winding yarn from textile bobbins onto other yarn packages, the improvement comprising:

(a) means for sorting textile bobbins into groups comprised respectively of empty bobbins, bobbins having less than a predetermined amount of residual yarn wrapped thereabout, and bobbins having greater than said predetermined amount of residual yarn wrapped thereabout, said sorting means including (i) sorting conveyor means having a yarn engaging surface and being arranged for upwardly inclined movement of said yarn engaging surface for upward conveyance and discharge therefrom of bobbins having residual yarn wrapped thereabout by engagement of the yarn by said yarn engaging surface and for downward sliding discharge therefrom of empty bobbins, and (ii) means for feeding bobbins onto said sorting conveyor means, said feeding means including transporting conveyor means passing adjacent said sorting conveyor means and being higher than said conveyor means at the location of adjacency for transporting bobbins along said transporting conveyor means and including side wall means extending between said sorting conveyor means and said transporting conveyor means, said side wall means including an opening therein of predetermined size at the location of adjacency of said transporting conveyor means to said sorting conveyor means to permit bobbins having less than a predetermined amount of residual yarn wrapped thereabout to fall through said opening onto said sorting conveyor means while preventing bobbins having greater than said predetermined amount of residual yarn wrapped thereabout from passing through said opening, such bobbins being conveyed by said transporting conveyor means to a discharge location;

(b) means for transporting to said transporting conveyor means spent bobbins from which yarn has been unwound by said winding apparatus; and (c) collection chute means disposed at said discharge location for receiving bobbins having greater than said predetermined amount of residual yarn thereon from said transporting conveyor means and transporting such bobbins to a storage position for unwinding of the residual yarn therefrom by said winding apparatus.

27. In an apparatus for winding yarn from textile bobbins onto other yarn packages, the improvement of claim 26 and characterized further in that said sorting conveyor means includes sorting belt means movable upwardly along an upper run extending from a lower end to an upper end for receiving bobbins on said upper run, said upper run being inclined sufficiently for sliding of empty bobbins downwardly therealong under the force of gravity and against the frictional forces created between said empty bobbins and said yarn engaging surface to fall from said lower end of said upper run, with said yarn engaging surface engaging the residual yarn on bobbins having residual yarn wrapped thereabout to carry said bobbins with residual yarn thereon upwardly along said upper run and against the force of gravity to fall from said upper end of said upper run.

28. In an apparatus for winding yarn from textile bobbins onto other yarn packages, the improvement of claim 26 and characterized further in that said yarn engaging surface includes a plurality of yarn engaging projections extending from said sorting conveyor means.

29. In an apparatus for winding yarn from textile bobbins onto other yarn packages, the improvement of claim 28 and characterized further in that said yarn engaging surface comprises card clothing, including a plurality of projecting wire teeth inclined in the direction of upward movement of said yarn engaging surface.

30. In an apparatus for winding yarn from textile bobbins onto other yarn packages, the improvement of claim 26, 27 or 29 and characterized further in that said sorting conveyor means and said transporting conveyor means are disposed in closely adjacent, generally parallel relation, in that bobbins are carried on said transporting conveyor means in generally axial alignment with the longitudinal extent thereof, and in that said transporting conveyor means is oriented in cross-section along the longitudinal extent thereof at a downward incline toward said side wall means such that bobbins being transported along said transporting conveyor means are maintained adjacent and are transported along said side wall means.

31. In an apparatus for winding yarn from textile bobbins onto other yarn packages, the improvement of claim 30 and characterized further in that said transporting conveyor means includes a plurality of bobbin engaging elements spaced longitudinally thereon at generally equal intervals and extending therefrom for engaging said bobbins for movement with said transporting conveyor means.

32. In an apparatus for winding yarn from textile bobbins onto other yarn packages, the improvement of claim 31 and characterized further in that said bobbin engaging elements are positioned on said transporting conveyor means adjacent said side wall means and are configured to each engage one bobbin, whereby said bobbins are transported sequentially along said transporting conveyor means.

* * * * *

UNITED STATES PATENT AND TRADEMARK OFFICE

CERTIFICATE OF CORRECTION

PATENT NO. : 4,295,569

DATED : October 20, 1981

INVENTOR(S) : Kurt W. Niederer

It is certified that error appears in the above—identified patent and that said Letters Patent is hereby corrected as shown below:

On the Title page the descriptive figure should appear as shown on the attached sheet:

Signed and Sealed this

*Ninth* Day of *February 1982*

[SEAL]

*Attest:*

GERALD J. MOSSINGHOFF

*Attesting Officer*

*Commissioner of Patents and Trademarks*